United States Patent [19]

Weber et al.

[11] 4,368,671

[45] Jan. 18, 1983

[54] DOME-SHAPED MOLDED COMPONENT FOR OPERATIVE ELEMENTS, ESPECIALLY MINES

[75] Inventors: Manfred Weber, Neunkirchen-Seelscheid; Dieter F. von Hinleder, Sindelfingen; Dieter Picht, Porz-Urbach; Klaus Fischer, Troisdorf, all of Fed. Rep. of Germany

[73] Assignee: Dynamit Nobel Aktiengesellschaft, Troisdorf, Fed. Rep. of Germany

[21] Appl. No.: 171,846

[22] Filed: Jul. 24, 1980

[30] Foreign Application Priority Data

Aug. 1, 1979 [DE] Fed. Rep. of Germany ..... 2931180

[51] Int. Cl.[3] ..... F42B 23/24

[52] U.S. Cl. ..... 102/401

[58] Field of Search ..... 102/401, 406, 411, 476

[56] References Cited

U.S. PATENT DOCUMENTS 3,543,684 12/1970 Radford ..... 102/406

3,875,862 4/1975 Fischer et al. ..... 102/476

4,304,186 12/1981 Fischer et al. ..... 102/401

*Primary Examiner*—Charles T. Jordan

*Attorney, Agent, or Firm*—Antonelli, Terry and Wands

[57] ABSTRACT

A dome-shaped molded component or device for use with an operative element, e.g. a hollow-charge mine, is adapted to be connected at a continuous rim with the operative element. The device comprises a flexible body formed of an elastic material and at least one venting means for venting a cavity defined by the body when the device is placed in its functional or operative position. The device also has a rib arranged on the body for causing the body to deploy from a collapsed introverted inoperative initial position to an extended extroverted, operative position. The body part of the device is compressed under elastic deformation and is held in this position by a retaining unit for applying an external force to the device so that the device is collapsed within the operative element. Upon release of the externally effective force, the rib effects the deployment of the body into its functional or operative position.

20 Claims, 3 Drawing Figures

DOME-SHAPED MOLDED COMPONENT FOR OPERATIVE ELEMENTS, ESPECIALLY MINES

The invention relates to a molded component or shaped device for use with operative elements, e.g. land mines, the component or device is formed of an elastic usually polymeric material and is shaped to provide a hollow cavity with the associated operative element.

A hollow-charge mine, described in DOS [German Unexamined Laid-Open Application] No. 2,207,557 is provided on one of its ends with a hemispherical, elastic cover. The cover extends over the end of the hollow charge equipped with an inert, conical, hemispherical, or the like lining or insert, and is fixedly joined to the mine housing. This dome-shaped cover serves for damping the impact of the mine on the ground when ejected from the air and when equipped with a brake parachute on the end opposite to the cover, so that the mine will hit the ground with the cover constituting a damping cushion. After impingement on the ground, the hollow-charge mine according to DOS No. 1,800,121 is positioned in such a way that the blast effect of the hollow charge is directed upwardly. The cover then ensures the presence of the free space above the hollow-charge insert necessary for forming the hollow-charge blast or flash.

In order to render the mines stackable and to save space, for example, during storage, transportation or installation of the mines in laying systems, it is desirable to reduce the hollow space or cavity underneath the cover, i.e. to be able to compress the cover at least approximately into a flat position. In this connection, one must make sure that the cover, before the mines are activated, i.e. for example, when the mines are released for distribution or laying, passes over this initial position with a reduced or optionally even entirely eliminated cavity into its operative position wherein the cavity is again fully formed.

This need exists, in particular, in the aforementioned hollow-charge mines, and, for example, also in case of corresponding dummy mines, bomblets, or the like. Furthermore, even in connection with shock-absorbing air cushions, for example, as such cushions are provided for other operative elements, devices, containers, or the like to be dropped from the air, such a cover or such a cavity-forming, dome-shaped molded component proves to be advantageous. Even in connection with floating devices such a molded component can be utilized. All of these devices, with which the cavity-forming, dome-shaped elastic molded component can be combined, are encompassed hereinafter by the term "operative element."

The invention is based on the object of providing a dome-shaped molded component formed of an elastic material shaped to provide a hollow cavity with the operative element which can be deployed automatically and thus forms the cavity necessary for its respective use in a simple manner; whereas the operative elements with a not-yet deployed molded component occupy a correspondingly smaller volume during storage, transportation, etc. prior to the use thereof. The shaped molded component, especially in the form of a cover cap, is deployed in its functional position in the manner of a dish, hemisphere, cap or the like. The part, as heretofore described, is made from an elastic material. Elastomers are especially utilized as such elastic materials, for example, elastomer based on silicone rubber, ethylene-propylene copolymers, chloroprene polymers, or natural rubber.

This object has been attained according to the invention by a construction which includes at least one external or internal rib that is arranged in the meridian and/or peripheral direction of the dome-shaped molded component and that is compressed in a particular manner by an externally applied force. The at least one rib according to the invention is deformed during the assembly of the molded component, when it is converted into its storage, transport, or like position, i.e. into its initial position, in such a way that restoring forces occur in this rib, tending to deploy the molded component into its dish-like, hemispherical, cap-shaped, or like functional position, i.e. the position in which a hollow cavity is formed. This deployment is prevented by holding forces acting from the outside on the deformed component, which forces can be packaging forces, for example, applied by means of a packaging, casing, trying, or the like occurring with the individual associated operative element, and are eliminated when the operative element is freed of such packaging. Preferably, however, the external holding force retaining the molded component in its deformed initial position is applied by accommodating several operative elements together in an orderly arrangement as a stack in a packaging, transporting, laying device or the like. In particular, the operative elements are arranged axially in series to form a cylindrical column, one supporting the other. The laying device can be constructed, for example, in case of mines, bomblets, or the like as the warhead of a rocket, of a projectile or the like.

The arrangement and structure of the at least one deployment rib according to this invention is to be such that the restoring force stored therein is sufficiently large to convert the molded component from its volume-reduced initial position into its functional position, and preferably also additionally stabilize the component in this position, i.e. to act along the lines of a reinforcing or rigidifying rib. The size of the stored restoring force depends on the elastic properties of the shaped molded component, the cross section, and the length of the rib, its arrangement on the inside or outside of the molded component, the direction in which the rib extends, and its degree of deformation in the initial position. For example, if the molded component in the initial position is only flattened to a greater or lesser extent, then compressive forces occur in the at least one rib which, after elimination of the outside holding force, effect the deployment of the molded component. Due to the stronger deformation, the deployment force attainable by means of a rib extending in the meridian direction is generally larger than that which can be attained by means of a rib extending in the peripheral direction.

Therefore, preferably, ribs are provided which extend at least approximately in the meridian direction, wherein particularly also several of these ribs are distributed over the circumference of the molded component. Depending on the conditions of a particular case, it can also be advantageous to arrange additionally one or more ribs extending at least approximately in the peripheral direction. The arrangement of the at least one rib on the inside or outside of the shaped part is of significance insofar as it is possible thereby to produce, depending on the specific configuration of the molded component in its volume-reduced initial position, intended tensile or compressive forces in the deformed rib, as will be explained in greater detail hereinafter.

The expression "extending in the meridian direction" means that the rib is located in a section plane passing through the central axis of the hemisphere defined by the deployed dome-shaped molded component. This rib thus will also be designated as an axial rib as contrasted to the peripheral rib. Preferably, the single rib, or the several ribs extend at least approximately in the meridian or peripheral direction. However, hybrid forms are also possible having respectively one component in the meridian and peripheral directions, for example in such a way that the rib—as seen in a top view of the deployed molded component—has the form of a spiral arc section.

By means of the at least one deployment rib according to the invention, it is possible advantageously to convert the molded component into its functional or operative position at a predetermined point in time without requiring any special force acting on the shaped part from the outside four this purpose. Thus, the shaped part according to the invention, after elimination of the external holding force, deploys itself due to the deployment force stored in the rib.

In a suitable embodiment of the invention, the provision is made to construct the at least one deployment rib as an outer rib that extends on the outer surface portion, i.e. that portion that faces outwardly from the caivity or hollow space defined by the molded component in the operative or functional position. Also, this rib extends approximately in the meridian direction from the marginal or peripheral rim portion of the molded component. This arrangement is advantageous, in particular, if the shaped component is introverted into its initial position, i.e. is not only more or less compressed, but also has been deformed in a direction in opposition to its functional position. Use is made of this feature especially with operative elements exhibiting on their side covered by the shaped component a corresponding recess, indentation, or the like, into which the shaped component can be pressed. This is the case, for example, in hollow charges for mines, bomblets, or the like, for which the shaped component of this invention is preferably intended. The shaped component or device can be introverted more or less deeply into the recess of the hollow charge or some other depression of the operative element. To hold the shaped component in this position the provision can be made, for example, in case of a column of several mutually supporting operative elements to fill the indentation formed by the introverting of the shaped component with an inert filler serving merely for transmitting the holding force and being ejected during the outward deflection of the shaped component. Instead of an inert filler, however, the indentation can also be filled, for example, with a brake parachute or the like for the operative element, or the shaped component can be fixed in the introverted condition by means of a correspondingly preformed (i.e. dome-shaped) holding bracket which is thrown off during the outward deflection.

The outer meridian rib emanating from the marginal zone of the shaped component is stretched during the introverting of the shaped component, i.e. when it is placed into its initial or stored position, so that tensile stresses are produced in this rib. Advantageously, this rib is made to be especially thick in the proximity of the marginal portion or zone since here the greatest bending deflection occurs during introversion, and thus the strongest tensile stresses occur at this point. The thickness of the rib preferably decreases toward the center of the shaped component. The length of the outer rib is dependent, inter alia, on the configuration of the shpaed component in its initial position. With the shaped component being introverted, the tensile stresses in the outer rib are decreased toward the center of the shaped component and finally even pass over into compressive stresses due to the local crushing of the outer rib as compared to the deployed condition. The outer axial rib is thus preferably only of such a length that in its end zone facing the center of the shaped component, there are not as yet any compressive stresses, or only insubstantial compressive stresses, in the initial position. This has the advantageous result that the introverted shaped component, after elimination of the external holding force in the initial position is pulled out by the single rib, but preferably several outer axial ribs, so vigorously that it passes over reliably into its extroverted functional position. This initial extroverting impulse is so strong that it is possible thereby to overcome the intermediate condition wherein the shaped component and, accordingly, also the outer ribs are compressed during extroverting, i.e. during deployment to the operative position.

This initial pulling out of the introverted shaped component by means of the axial outer rib or ribs can be further enhanced advantageously by additionally providing one or more axial inner ribs, namely in an area of the shaped part which is compressed during the pulling out step so that compressive forces are built up in the axial ribs. This has the result that, starting with a deployment phase of the shaped component depending on the particular case, the compressive forces of the inner ribs promote the further extroverting process instead of the decreasing tensile forces in the outer ribs. If the spatial and functional conditions of the operative element, especially one with a hollow charge, permit this, the above-mentioned at least one axial inner rib can likewise start right at the marginal zone of the shaped component so that it is initially crushed with the molded component being introverted, and thus compressive forces are produced which right from the beginning promote the extroversion of the molded component.

According to a further embodiment of the invention, the provision can be made in case of several inner and/or outer axial ribs to arrange the ribs so that the ribs are distributed over the circumference of the shaped component at irregular mutual spacings. This makes it possible to reduce the total number of the ribs. The deployment or extroverting of the shaped component takes place primarily in the zone of the ribs, whereby secondarily, due to the elastic behavior of the shaped component, the zones free of ribs follow with a delay, i.e. they are converted into their functional position somewhat laggingly with respect to time.

The construction of the elastic shaped component according to this invention with integrally incorporated ribs of various type and arrangement makes it possible to convert the shaped component from its volume-reduced initial position into its cavity-forming functional position without additional deployment force, i.e. solely on the basis of the forces stored in the rib or ribs and due to its or their elastic deformation. The cross section of the ribs can be kept comparatively small, i.e. only a locally minor thickening of the shaped component is necessary. This is of special importance for shaped components to cover hollow charges in order to avoid an undesirable impairment of the formation of the hollow-charge blast by the shaped component and/or the ribs thereof.

The ribs arranged at the shaped component according to the invention exhibit, however, moreover a still further considerable advantage. In order to be able to convert the molded component into its functional position, venting of the space between this component and the operative element is necessary. With a shaped component tightly joined along the marginal zone to the operative element along its rim, at least one vent opening is normally arranged in the shaped component for this purpose. This opening should preferably be closed in the functional position of the shaped component to seal the space underneath the shaped component against environmental influences, such as moisture, dirt, penetration of water, or the like, in a hermetic fashion. For this purpose the vent opening can be equipped with a valve which is held open by extraneous force during the deployment process of the shaped component. However, instead, a valve is preferably provided for this purpose, which can be actuated according to the invention without additional extraneous force. This is achieved by providing the vent opening with a closure element covering the opening which element, in the functional position of the shaped component, on the one hand, sealingly contacts the shaped component under pretensioning, but on the other hand, in the volume-reduced initial position of the shaped component, due to the buckling thereof, is loose with respect thereto, i.e. it is no longer in contact under pretensioning and thus uncovers the vent opening. This self-venting diaphragm valve according to the invention is thus operated by the deployment force stored in the at least one rib of the shaped component, which is so large that it urges the shaped component into such a deployed form, and stabilizes same in this form, so that the closure element is elastically elongated and thus is in sealing contact under pretensioning. The closure element can be arranged on the inside of the shaped component, but is preferably mounted on the outside to make sure that the opening is perfectly tight even in case of outside stress—for example, a pressure of 1 meter $H_2O$ column.

In order to increase the sealing effect, i.e. the specific pressure per unit area under equal pretensioning, an arrangement is provided with the vent opening surrounded by a raised sealing surface. For the additional stabilization of the shaped component in its deployed form, especially in the zone of the at least one vent opening, even under additional external stresses, a rib arrangement is provided. The connecton of the elongated closure element with the shaped component takes place preferably by shape mating, for example by buttoning the element with its two ends onto or into the shaped component. However, the connection can also be effected, for example, by cementing, vulcanizing, welding, or the like. In case of the use of the shape-mating connection, the shaped component is preferably formed with a contact surface that is increased in wall thickness at the junction zones.

The shaped component of this invention with at least one self-venting diaphragm valve and automatic deployment ribs extending in the axial and/or peripheral direction with an additional reinforcing function can be manufactured at very low expense and ensures, without additional external forces, a flawless conversion of the shaped component into its functional position and an externally tight seal of the cavity then formed underneath the shaped part. If, for example, an operative element, dropped from the air, hits the ground with this deployed component, the shock absorbing effect is not only provided by the air cushion underneath the shaped component, but additionally also by the rib arrangement, namely the more effective the deploying effect, the more this arrangement exhibits, in addition to its primary deployment function, also a secondary reinforcing function. The shaped component of this invention is preferably as a cover cap for hollow charges, especially for those of mines, bomblets or the like.

The invention is shown in one embodiment in the drawing and will be explained in greater detail below with reference thereto. In the drawing.

Figure 1:
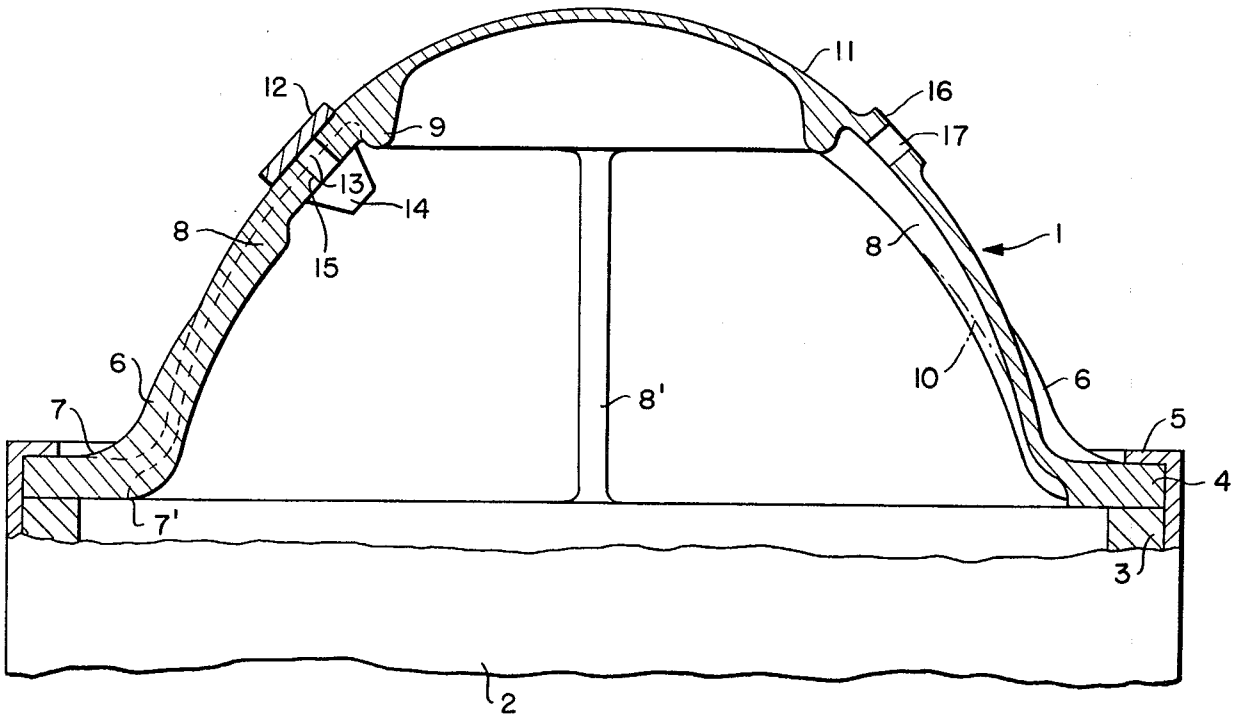
FIG. 1 shows the shaped component in its functional or operative position in a meridian or axial section.

The dome-shaped molded component or device 1 shown in FIG. 1 is constructed as a cover cap for an operative element 2 which is a hollow-charge mine. Only the upper casing rim 3 is shown of the operative element 2; the thickened, annular edge 4 of the shaped component 1 rests on this upper casing rim and is tightly clamped in position by means of the flanged-over collar 5 of the operative element 2. The shaped component 1 is provided with the outer axial or meridian ribs 6 that start at the marginal zone 7 and that extend to about one-third of the height of the shaped component. In opposition to the outer axial ribs 6, the inner axial ribs 8 are additionally arranged. These inner ribs start at the marginal zone 7' and extend upwardly to the annular, inner peripheral rib 9. The width of the axial ribs can be seen from the central inner axial rib 8' shown in plan view. As indicated by the dot-dash line 10, the inner axial ribs 8 can also terminate at a spacing from the marginal zone 7'.

The inner peripheral rib 9 is formed approxiately at two-thirds the height of the shaped component 1, where also the two diaphragm valves are arranged. The peripheral rib 9 serves for promoting deployment as well as, together with the axial ribs 8, for reinforcing the shaped component in the zone of the valves. The central area 11 of the shaped component 1 is free of ribs or other elements so that the hollow-charge blast produced during reaction of the hollow charge is practically unimpaired in its effect. The ribs can, however, also be continued optionally up to the middle of the shaped component.

In the left-hand half of FIG. 1 the flap-like closure element 12 of the diaphragm valve is shown in section, this element being provided on both of its ends with respectively one pin-shaped web 13 having at its free end the thickened portion 14 and being pressed through the mounting aperture 15 of the shaped component. By this "buttoning step" the closure element 12 is shaped-matingly joined to the shaped component 1 with its two ends. The closure element is, under pretensioning, in close contact with the sealing area 16, which latter is raised in the manner of a cam and surrounds the actual vent hole 17 shown in the right-hand half of FIG. 1. The closure element, covering the vent hole 17 and thereby sealing it, is not shown in the right-hand half of FIG. 1.

Figure 2:
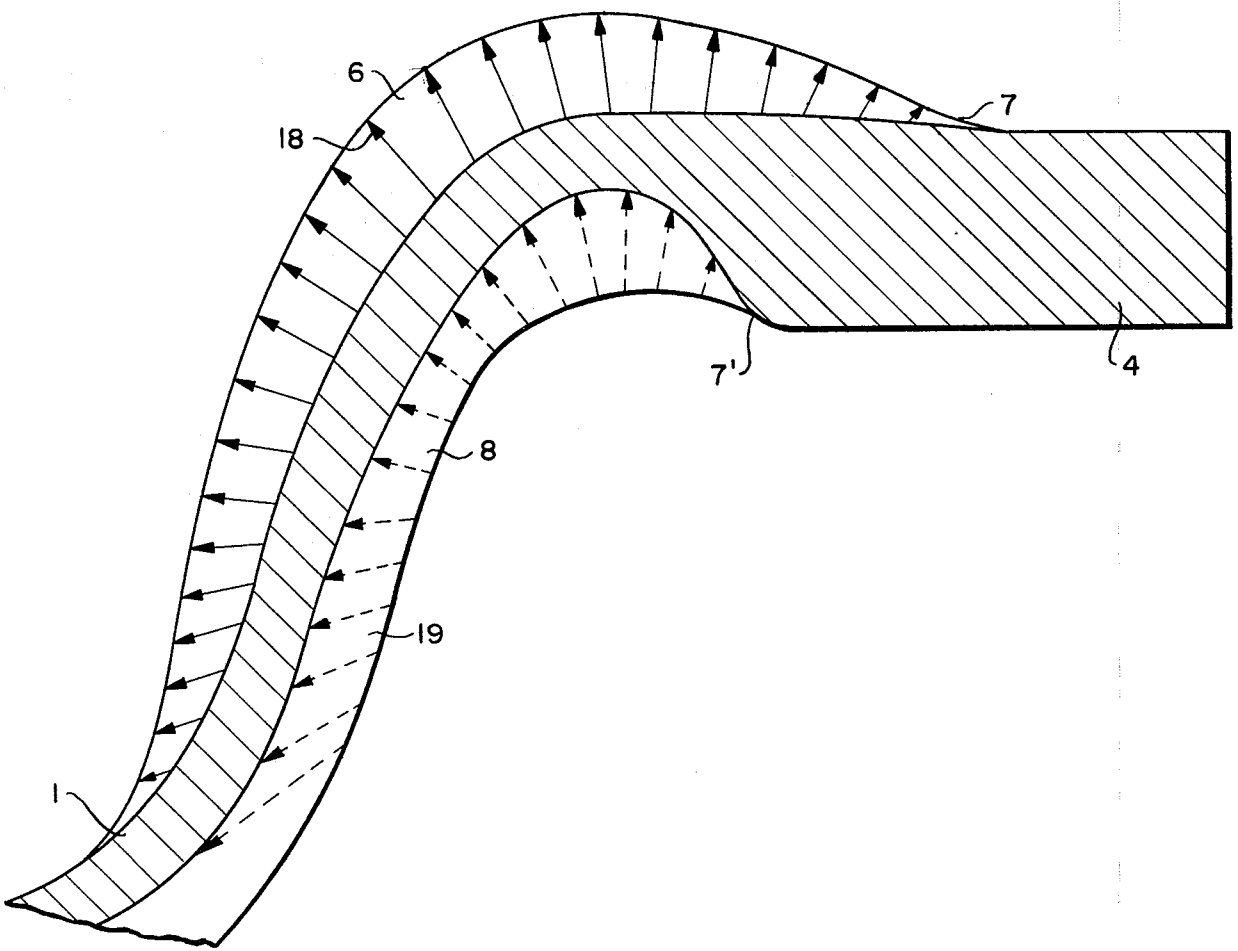
FIG. 2 shows a fragmentary view of the marginal zone of the introverted shaped component in an enlarged illustration.

In FIG. 2 the shaped component 1 is shown in the introverted condition in the starting position, in a fragmentary view. The parts of the operative element have been omitted for the sake of simplicity. The tensile forces occurring in the outer axial rib 6, stretched by the introversion, are indicated by the arrows 18; whereas the corresponding compressive forces are symbolized in the crushed inner axial rib 8 by the dashed arrows 19. The tensile forces as well as the compressive forces effect the "popping out" of the introverted shaped component 1 into its functional position illustrated in FIG. 1 once the holding force acting from the outside on the operative element and/or the shaped component has been eliminated.

Figure 3:
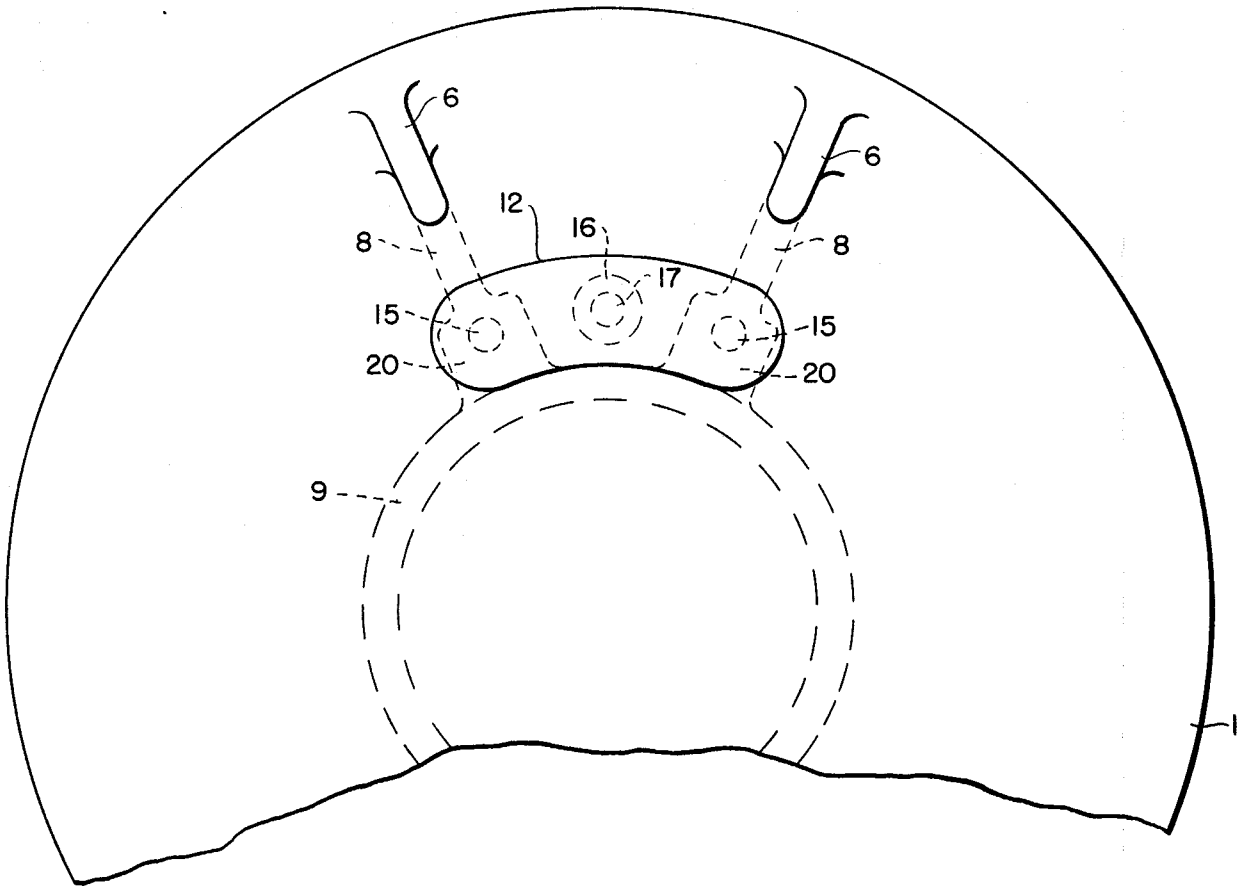
FIG. 3 shows the shaped component in a top view.

In FIG. 3, finally, the deployed shaped component 1 is shown in a top view, the lower half of the shaped component (as shown in this view) which is constructed identical to the upper half, is shown only in part for reasons of space. Between the two outer axial ribs 6 and the two inner axial ribs 8 shown in dashed lines, the vent aperture 17 with its sealing area 16 is arranged. The inner axial ribs are thickened at their upper end 20 to receive the mounting holes 15 and pass over into the inner peripheral rib 9. The axial ribs 6 and 8, respectively, are here arranged so that they are distributed over the circumference of the shaped component at irregular mutual spacings. The flap-like closure element 12 contacts the sealing surface 16, raised in a cam-like fashion, of the vent opening 17 under pretensioning. Thereby the required hermetic seal with respect to the environment is ensured in the functional position of the shaped component, while when the shaped component is in the initial position, the closure element 12 is loosened by the compression of the shaped component and the thereby caused reduction of the distance between the two mounting holes 15 and thus uncovers the vent opening 17 so that the space underneath the shaped component, i.e. the interior, can be vented.

It will be appreciated that the molded component or device of this invention, as shown in FIG. 1, has a flexible body portion in the shape of a hemisphere or dome and that the ribs (external and/or internal ribs) are formed integrally with the body portion; the resulting unitary construction can be formed by a single molding operation.

We claim:

1. A dome-shaped molded component for use with an operative element, especially a mine, which is adapted to be connected at a continuous rim with the operative element, said component being extroverted in its functional position to form a cavity with respect to the operative element, and is formed of an elastic material, characterized in that the molded component has rib means extending thereon and, in its initial position, the molded component is compressed under elastic deformation by means of an externally effective force and is held in a position wherein it is pressed against the operative element, introverted, wherein forces occur in the ribs means in dependence on the arrangement and deformation of said rib means, these forces effecting, after elimination of the external force, the deployment of the molded component into its functional operative position.

2. A molded component according to claim 1, characterized in that the rib comprises at least one rib fashioned as an outer rib extending at least approximately in the meridian direction and emanating from a marginal zone of the molded component.

3. A molded component according to claim 1 or claim 2 with said rib means comprising two or more ribs extending at least approximately in the meridian direction, characterized in that the ribs are arranged and distributed over the circumference of the molded component at irregular mutual spacings.

4. A molded component according to claim 1 or claim 2, characterized in that the molded component has at least one vent opening with a closure element that covers the opening, said closure element leaving the vent opening uncovered in the initial position of the molded component, but in the functional position of the molded component sealingly contacting the vent opening under pretensioning by the deployment force of the rib means.

5. A molded component according to claim 4, characterized in that the vent opening on its side facing the closure element is surrounded by a sealing surface which is raised in a cam-like fashion.

6. A molded component according to claim 5, characterized in that the molded component has at least one inner peripheral rib in the zone of the vent opening.

7. A molded component according to claim 4, characterized in that the molded component has at least one inner meridian rib extending into the zone of the vent opening.

8. A molded component according to claim 4, characterized in that the closure element is connected with its two ends to the molded component by shape-mating.

9. A molded component according to claim 1, characterized in that the rib means comprises at least one rib extending in the meridian direction and at least one rib extending in the peripheral direction of said component.

10. A molded component according to claim 1, characterized in that said rib means comprises at least one outer rib and at least inner rib extending in the meridian direction of said molded component.

11. A molded component according to claim 1, characterized in that the rib means comprises at least one outer rib and at least one inner rib extending in the peripheral direction of said molded component.

12. A molded component according to claim 1, characterized in that the component in its functional position is in the shape of a hemisphere.

13. A dome-shaped device for use with a hollow-charge mine, which is adapted to be connected at a continuous rim with the hollow-charge mine, said device comprising a flexible body portion formed of an elastic material and at least one venting means for venting a cavity defined by said body portion when the device is placed in the functional or operative position, said device having rib means arranged on the body portion for causing the body portion to deploy from a collapsed introverted, inoperative initial position to an extended extroverted, operative position, said body portions being compressed under elastic deformation and being held in this position by means for applying an external force to said device so that the device is collapsed within the hollow-charge mine and whereby upon release of the externally effective force said rib means effect the deployment of the body portion into its functional or operative position.

14. The device according to claim 13, wherein said rib means includes at least one rib extending on the body portion with respect to an annular edge portion of the body portion, which annular edge portion is adapted to contact the rim of the hollow-charge mine.

15. The device according to claim 14, wherein said rib means includes at least one outer rib extending in the meridian direction of the body portion.

16. The device according to claim 14, wherein said rib means includes at least one outer and at least one inner rib extending in the meridian direction of the body portion.

17. The device according to claim 14, wherein said rib means includes at least one inner rib extending in the meridian direction of the body portion.

18. The device according to claim 14, wherein said rib means includes at least one inner rib extending in the peripheral direction of the body portion.

19. The device according to claim 14, wherein said rib means includes at least one outer rib and at least one inner rib extending in the peripheral direction of the body portion.

20. The device according to claim 14, wherein said rib means includes at least one rib extending in the meridian direction and at least one rib extending in the peripheral direction of the body portion.

* * * * *